US006048258A

United States Patent [19]

Shibata

[11] Patent Number: 6,048,258

[45] Date of Patent: Apr. 11, 2000

[54] APPARATUS FOR GRINDING EYEGLASS LENS

[75] Inventor: Ryoji Shibata, Aichi, Japan

[73] Assignee: Nidek Co., Ltd., Aichi, Japan

[21] Appl. No.: 09/050,358

[22] Filed: Mar. 31, 1998

[30] Foreign Application Priority Data

Mar. 31, 1997 [JP] Japan ..... 9-098219
Jan. 20, 1998 [JP] Japan ..... 10-023845

[51] Int. Cl.[7] ..... B24B 7/00

[52] U.S. Cl. ..... 451/277; 451/5

[58] Field of Search ..... 451/5, 6, 43, 240, 451/255, 256, 277, 325, 384, 390

[56] References Cited

U.S. PATENT DOCUMENTS

| | | | |
|---|---|---|---|
| 5,138,770 | 8/1992 | Matsuyama | 33/28 |
| 5,228,242 | 7/1993 | Matsuyama | 51/165.74 |
| 5,333,412 | 8/1994 | Matsuyama | 51/165.71 |
| 5,347,762 | 9/1994 | Shibata et al. | 451/15 |
| 5,716,256 | 2/1998 | Mizuno et al. | 451/5 |
| 5,803,793 | 9/1998 | Mizuno et al. | 451/5 |
| 5,890,949 | 4/1999 | Shibata | 451/5 |

FOREIGN PATENT DOCUMENTS

| | | | |
|---|---|---|---|
| 0 798 076 A1 | 10/1997 | European Pat. Off. | B24B 9/14 |
| 3-20603 | 1/1991 | Japan | G01B 5/06 |

*Primary Examiner*—Rodney A. Butler
*Attorney, Agent, or Firm*—Sughrue, Mion, Zinn, Macpeak & Seas, PLLC

[57] ABSTRACT

A lens grinding apparatus that can process the edge of a lens to have a satisfactory polished surface and fit snugly into the user's eyeglass frame. The apparatus includes frame configuration data input device for entering data on the configuration of the eyeglass frame, layout data input device for entering data to be used in providing a layout of the lens corresponding to the eyeglass frame, lens rotating shafts that hold the lens therebetween and rotate it, a finishing abrasive wheel rotating shaft having a finish abrasive wheel, a polishing abrasive wheel rotating shaft having a polishing abrasive wheel, computer which, on the basis of the information from the frame configuration data input device and the layout data input device, determines the locus of processing with the polishing abrasive wheel such that the amount of polishing after finish processing increases as the point of polishing departs from the line connecting the polishing abrasive wheel rotating shaft and each of the lens rotating shafts, and processing controller which controls the processing of the lens based on the result of calculation by the computer.

5 Claims, 9 Drawing Sheets

APPARATUS FOR GRINDING EYEGLASS LENS

BACKGROUND OF THE INVENTION

The present invention relates to a lens grinding apparatus for grinding a lens such that it conforms to the shape of an eyeglass frame.

Some types of lens grinding apparatus are adapted to have a capability for performing polishing (specular processing) such that an edge surface of the lens is polished to have a mirror-like gloss.

Conventionally, the amount of polishing to be performed after finish processing is typically set to 0.1 mm and the entire periphery of the lens is processed with its edge surface being pressed into contact with a polishing abrasive wheel such that the distance between the abrasive wheel rotating shaft and each of the lens rotating shaft will vary by that amount of polishing.

A problem with this method is that the amount of lens grinding decreases as the point of processing (i.e., the point at which the edge surface of the lens is pressed into contact with the abrasive wheel) departs from the line connecting the abrasive wheel rotating shaft and each of the lens rotating shafts.

Furthermore, if the point of processing does not lie on the line connecting the abrasive wheel rotating shaft and each of the lens rotating shafts, the lens relief that is caused by the rigidity of the lens chucking/holding portion has an effect on the amount of processing such that it decreases even if the processing pressure is the same. Depending on the actual setting of the amount of polishing (specular processing), a certain part of the lens cannot be ground at all and it fails to be polished to have the desired polished surface.

One may think of increasing the setting of the amount of polishing in order to ensure that no part of the lens will remain unpolished despite the lens relief. If the lens to be processed has a thin edge, this approach is effective and the lens can be processed by an amount substantially equal to the desired amount; however, the amount of grinding is prone to decrease if the lens has a thick edge. As a result, the shape of the polished lens is variable with its edge thickness, occasionally making it impossible to produce lenses that fit snugly to the user's eyeglass frame. To avoid this problem, the amount of polishing is preferably as small as possible.

SUMMARY OF THE INVENTION

The present invention has been accomplished under these circumstances and has as an object providing a lens grinding apparatus that can process the edge of a lens to have a satisfactory polished surface and fit snugly to the user's eyeglass frame.

The present invention provides the followings:

(1) A lens grinding apparatus for grinding a lens such that it conforms to the shape of an eyeglass frame, the apparatus comprising:

frame configuration data input means for entering data on the configuration of the eyeglass frame;

layout data input means for entering data to be used in providing a layout of the lens corresponding to the eyeglass frame;

lens rotating shafts holding the lens therebetween to rotate it about a first axis, a finishing abrasive wheel rotating shaft having a finnish abrasive wheel and defining a second axis, a polishing abrasive wheel rotating shaft having a polishing abrasive wheel and defining a third axis, computing means which, on the basis of the information from the frame configuration data input means and the layout data input means, determines the locus of processing such that the amount of polishing after finish processing increases as the point of processing with the polishing abrasive wheel departs from the line connecting the first and third axes; and processing control means for controlling the processing of the lens based on the result of calculation by the computing means.

(2) A lens grinding apparatus according to (1), wherein the locus of processing as determined by the computing means is the locus of polishing on the finished lens shape which is to be obtained by finish processing performed on the basis of the information from the frame configuration data input means and the layout data input means, and wherein the processing control means controls the polishing on the basis of the locus of polishing.

(3) A lens grinding apparatus according to (1), wherein the computing means includes:

first corrected locus computing means for determining a first corrected locus such that the finished lens shape which is to be obtained by finish processing is corrected on the basis of the diameter of the polishing abrasive wheel, the amount of polishing and a specified amount of correction; and second corrected locus computing means for determining a second corrected locus such that the first corrected locus is adjusted by the specified amount of correction along the line connecting the first and third axes, and wherein the processing control means controls the polishing on the basis of the second corrected locus.

(4) A lens grinding apparatus according to (1), wherein the computing means determines both the locus of finish processing with the finishing abrasive wheel and the locus of polishing with the polishing abrasive wheel, and wherein the processing control means controls not only finish processing based on the locus of finish processing but also polishing based on the locus of polishing.

(5) A lens grinding apparatus according to claim (1), wherein the computing means includes:

first corrected locus computing means for determining a first corrected locus such that the lens shape based on the information from the frame configuration data input means and the layout data input means is corrected by addition of the diameter of the finishing abrasive wheel and a specified amount of correction;

second corrected locus computing means for determining a second corrected locus such that the first corrected locus is adjusted by the specified amount of correction along the line connecting the first and second axes; and third corrected locus computing means for determining a third corrected locus such that the lens shape based on the information from the frame configuration data input means and the layout data input means is corrected by addition of the diameter of the polishing abrasive wheel and the amount of polishing, and wherein the processing control means controls not only finish processing based on the second corrected locus but also polishing based on the third corrected locus.

(6) A lens grinding apparatus for grinding a lens such that it conforms to the shape of an eyeglass frame, the apparatus comprising:

frame configuration data input means for entering data on the configuration of the eyeglass frame;

layout data input means for entering data to be used in providing a layout of the lens corresponding to the eyeglass frame;

lens rotating shafts for holding the lens therebetween to rotate it;

a finishing abrasive wheel rotating shaft having a finishing abrasive wheel;

a polishing abrasive wheel rotating shaft having a polishing abrasive wheel;

correcting means for determining a locus of polishing which corrects the lens relief resulting from the rigidity of a lens chucking/holding portion; and processing control means for controlling the polishing of the lens based on the locus of polishing determined by the correcting means.

(7) A lens grinding apparatus for grinding a lens such that it conforms to the shape of an eyeglass frame, the apparatus comprising:

data input means for entering data on the configuration of the eyeglass frame and data to be used in providing a layout of the lens corresponding to the eyeglass frame;

lens rotating shafts for holding the lens therebetween to rotate it about a first axis;

a polishing abrasive wheel rotating shaft having a polishing abrasive wheel and defining a second axis;

computing means which, on the basis of the information from the data input means, determines a locus of polishing such as to provide a generally uniform amount of polishing along the line dropped perpendicular to the edge surface of the lens after finish processing; and processing control means for controlling the processing of the lens based on the result of calculation by the computing means.

(8) A lens grinding apparatus according to (7), wherein the computing means determines the amount of correction by dividing the amount of polishing by $\cos\tau$, where $\tau$ is the angle the line dropped perpendicular to the edge surface of the lens after finish processing forms with the line connecting the first and second axes, and determines the locus of polishing by adjusting the amount of correction along the line connecting the first and second axes.

DETAILED DESCRIPTION OF THE PREFERRED EMBODIMENTS

Embodiments of the invention will now be described in detail with reference to the accompanying drawings.

First Embodiment

Figure 1:
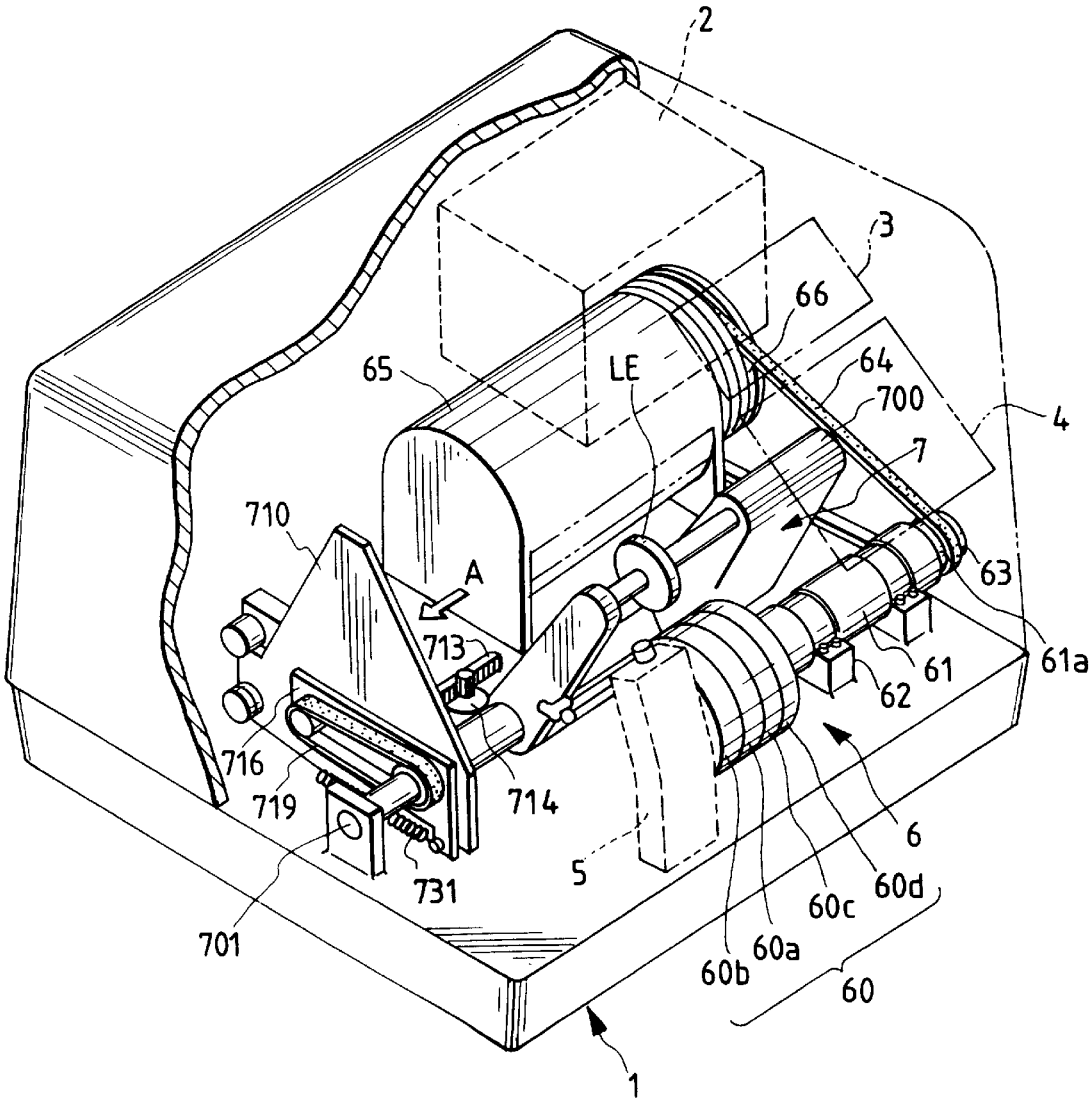
FIG. 1 is a perspective view showing the general configuration of the lens grinding apparatus of the invention.

FIG. 1 is a perspective view showing the general layout of the eyeglass lens grinding apparatus of the invention. The reference numeral 1 designates a base, on which the components of the apparatus are arranged. The numeral 2 designates an eyeglass frame and template configuration measuring section, which is incorporated in the upper section of the grinding apparatus to obtain three-dimensional configuration data on the geometries of the eyeglass frame and the template. Arranged in front of the measuring section 2 are a display section 3 which displays the results of measurements, arithmetic operations, etc. in the form of either characters or graphics, and an input section 4 for entering data or feeding commands to the apparatus. Provided in the front section of the apparatus is a lens configuration measuring section 5 for measuring the configuration (edge thickness) of an unprocessed lens.

The reference numeral 6 designates a lens grinding section, where an abrasive wheel group 60 made up of a rough abrasive wheel 60*a* for use on glass lenses, a rough abrasive wheel 60*b* for use on plastic lenses, a finishing abrasive wheel 60*c* for bevel (tapered edge) and plane processing operations and a polishing (specular processing) abrasive wheel 60*d* for polished-bevel and polished-plane processing operations is mounted on a rotating shaft 61*a* of a spindle unit 61, which is attached to the base 1. The reference numeral 65 designates an AC motor, the rotational torque of which is transmitted through a pulley 66, a belt 64 and a pulley 63 mounted on the rotating shaft 61*a* to the abrasive wheel group 60 to rotate the same. Shown by 7 is a carriage section and 700 is a carriage.

(Layout of the Major Components)

Next, the layout of the major components of the apparatus will be described.

(A) Carriage section

Figure 2:
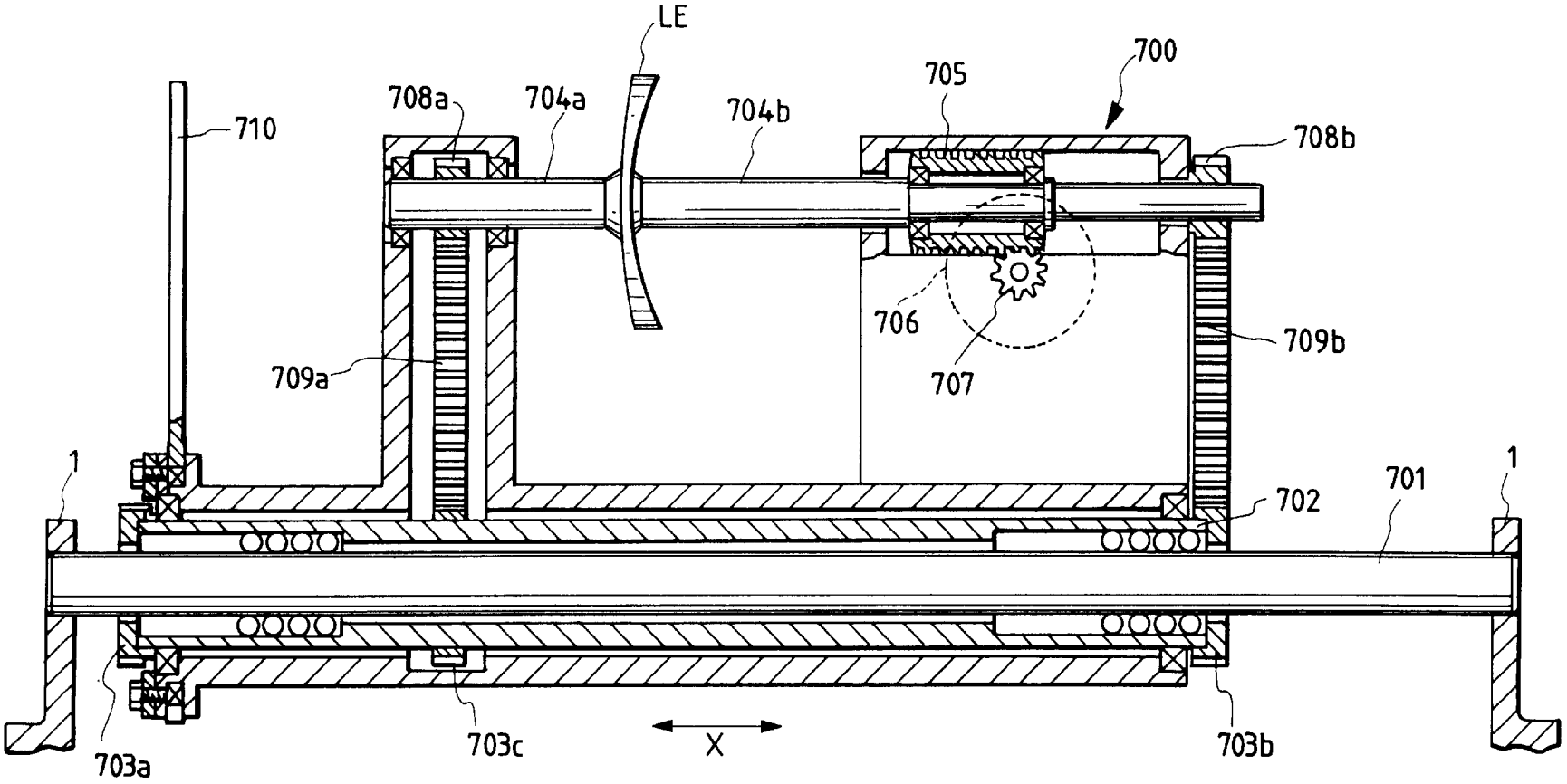
FIG. 2 is a sectional view illustrating the configuration of a carriage.
Figure 3:
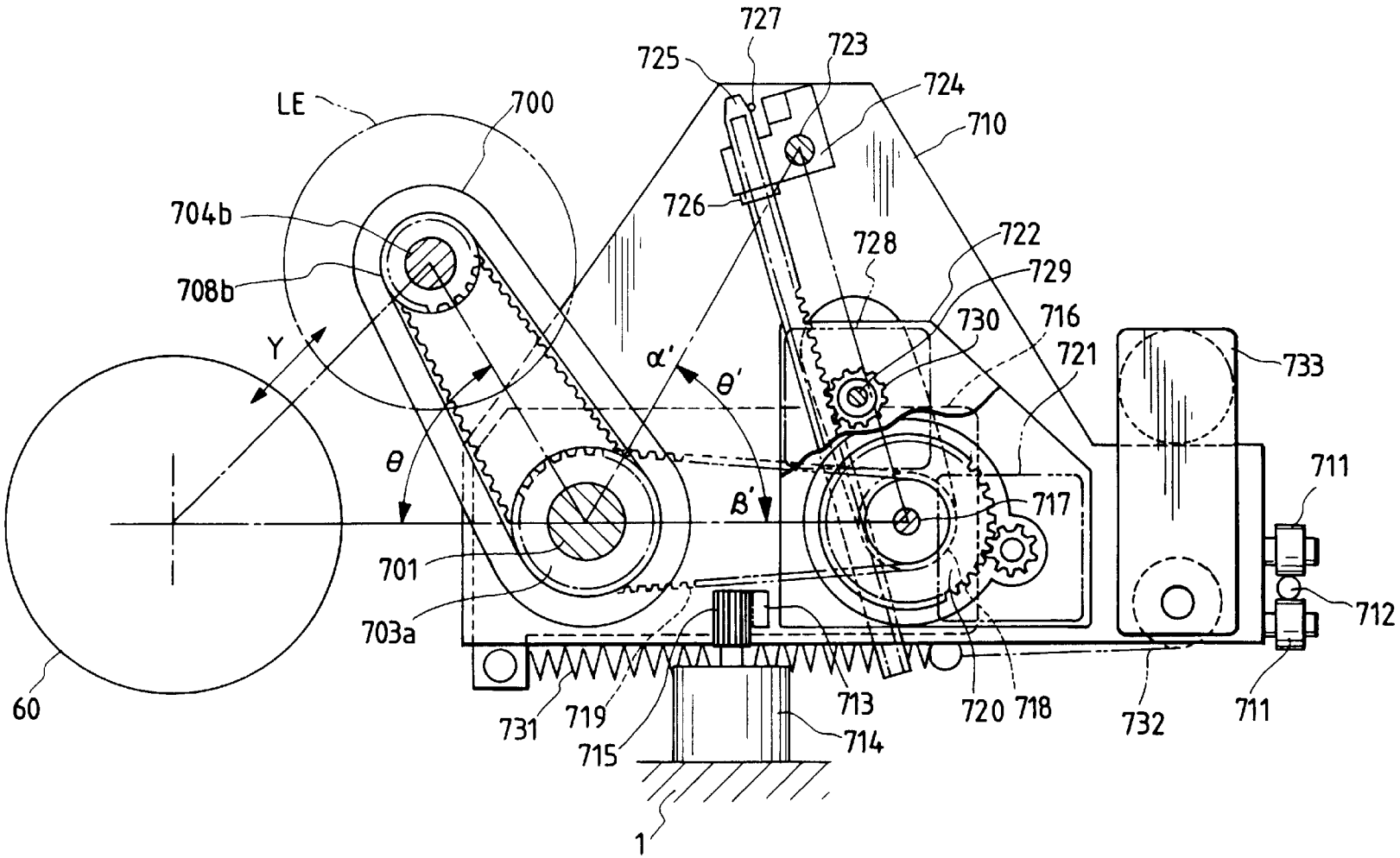
FIG. 3 is a diagram showing a carriage drive mechanism as seen in the direction of arrow A of FIG. 1.

The construction of the carriage section will now be described with reference to FIGS. 1 to 3. FIG. 2 is a cross-sectional view of the carriage, and FIG. 3 is a diagram showing a drive mechanism for the carriage, as viewed in the direction of arrow A in FIG. 1.

A shaft 701 is secured on the base 1 and a carriage shaft 702 is rotatably and slidably supported on the shaft 701; the carriage 700 is pivotally supported on the carriage shaft 702. Lens rotating shafts 704*a* and 704*b* are coaxially and rotatably supported on the carriage 700, extending parallel to the shaft 701. The lens rotating shaft 704*b* is rotatably supported in a rack 705, which is movable in the axial direction by means of a pinion 707 fixed on the rotational shaft of a motor 706; as a result, the lens rotating shaft 704*b* is moved axially such that it is opened or closed with respect to the other lens rotating shaft 704*a*, thereby holding the lens LE in position.

A drive plate 716 is securely fixed at the left end of the carriage 700 and a rotational shaft 717 is rotatably provided on the drive plate 716, extending parallel to the shaft 701. A pulse motor 721 is fixed to the drive plate 716 by means of a block 722. The rotational torque of the pulse motor 721 is transmitted through a gear 720 attached to the right end of the rotating shaft 717, a pulley 718 attached to the left end of the rotating shaft 717, a timing belt 719 and a pulley 703*a* to the shaft 702. The rotational torque thus transmitted to the shaft 702 is further transmitted through a timing belts 709*a*, 709*b*, pulleys 703*b*, 703*c*, 708*a*, and 708*b* to the lens rotating shafts 704*a* and 704*b* so that the lens rotating shafts 704*a* and 704*b* rotate in synchronism.

An intermediate plate 710 has a rack 713 which meshes with a pinion 715 attached to the rotational shaft of a carriage moving motor 714, and the rotation of the pinion 715 causes the carriage 700 to move in an axial direction of the shaft 701.

The carriage 700 is pivotally moved by means of a pulse motor 728. The pulse motor 728 is secured to a block 722 in such a way that a round rack 725 meshes with a pinion 730 secured to the rotational shaft 729 of the pulse motor 728. The round rack 725 extends parallel to the shortest line segment connecting the axis of the rotational shaft 717 and that of the shaft 723 secured to the intermediate plate 710; in addition, the round rack 725 is held to be slidable with a certain degree of freedom between a correction block 724 which is rotatably fixed on the shaft 723 and the block 722. A stopper 726 is fixed on the round rack 725 so that it is capable of sliding only downward from the position of contact with the correction block 724. With this arrangement, the axis-to-axis distance r' between the rotational shaft 717 and the shaft 723 can be controlled in accordance with the rotation of the pulse motor 728 and it is also possible to control the axis-to-axis distance r between the abrasive wheel rotating shaft 61*a* and each of the lens rotating shafts 704*a* and 704*b* since r has a linear correlationship with r'.

The arrangement of the carriage section of the present invention is basically the same as that described in the commonly assigned U.S. Pat. No. 5,347,762, to which the reference should be made.

(B) Eyeglass Frame and Template Configuration Measuring Section

Figure 4:
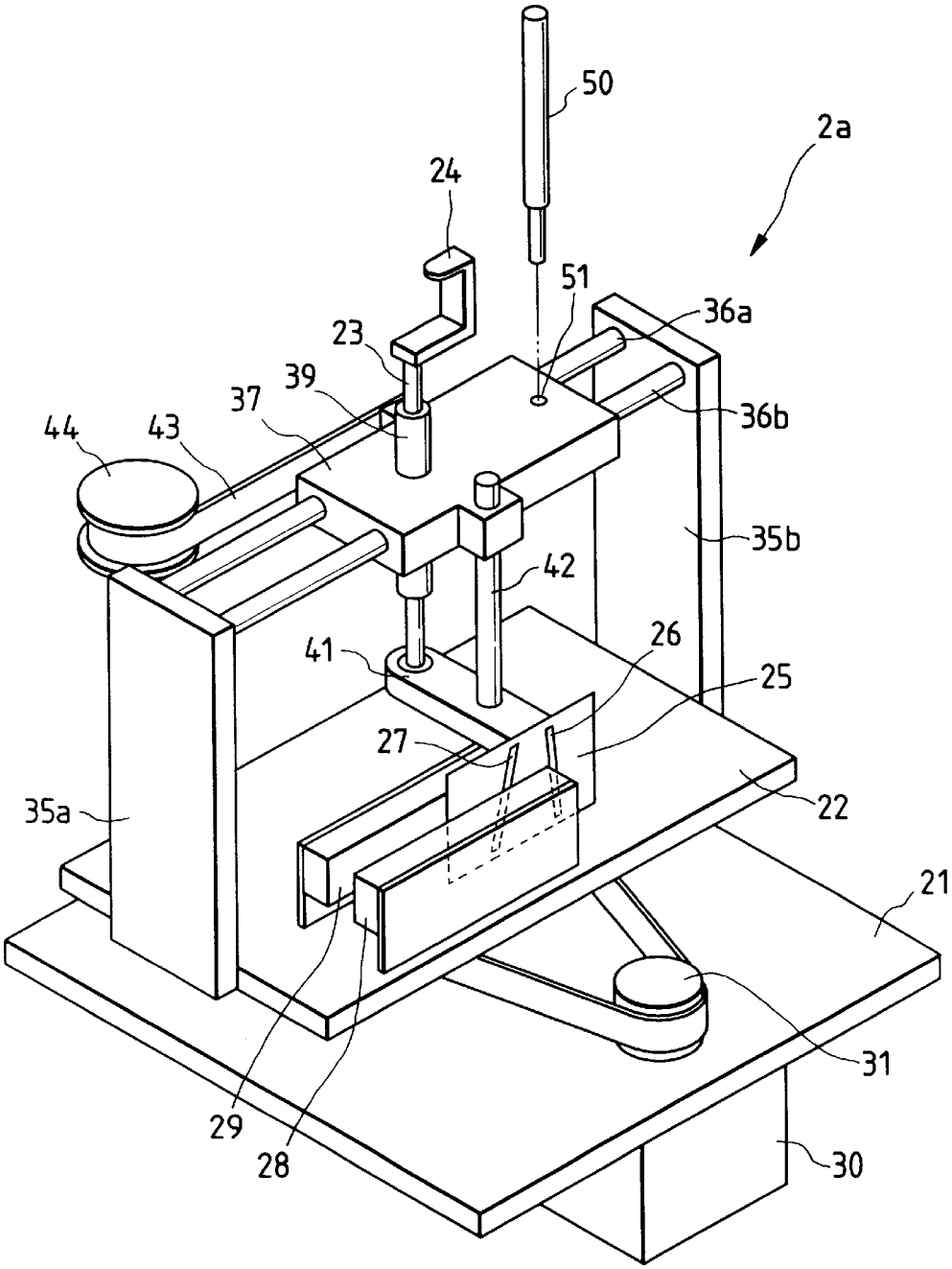
FIG. 4 is a perspective view of a configuration measuring section of an eyeglass frame and template configuration measuring section.

FIG. 4 is a perspective view of a configuration measuring section 2*a* of the eyeglass frame and template configuration measuring section 2. The configuration measuring section 2*a* comprises a moving base 21 which is movable in a horizontal direction, a rotating base 22 which is rotatably and axially supported on the moving base 21 and which is rotated by a pulse motor 30, a moving block 37 which is movable along two rails 36*a* and 36*b* supported on retainer plates 35*a* and 35*b* provided vertically on the rotating base 22, a gage head shaft 23 which is passed through the moving block 37 in such a way that it is capable of both rotation and vertical movements, a gage head 24 attached to the top end of the gage head shaft 23 such that its distal end is located on the central axis of the shaft 23, an arm 41 which is rotatably attached to the bottom end of the shaft 23 and is fixed to a pin 42 which extends from the moving block 37 vertically, a light shielding plate 25 which is attached to the distal end of the arm 41 and which has a vertical slit 26 and a 450 inclined slit 27, a combination of a light-emitting diode 28 and a linear image sensor 29 which are attached to the rotating base 22 to interpose the light shielding plate 25 therebetween, and a constant-torque spring 43 which is attached to a drum 44 rotationally and axially supported on the rotating base 22 and which normally pulls the moving block 37 toward the distal end of the head gage 24.

The moving block 37 also has a mounting hole 51 through which a measuring pin 50 is to be inserted for measurement of the template.

The configuration measuring section 2*a* having the construction just described above measures the configuration of the eyeglass frame in the following manner. First, the eyeglass frame is fixed in a frame holding portion (not shown but see, for example, U.S. Pat. No. 5,347,762) and the distal end of the gage head 24 is brought into contact with the bottom of the groove formed in the inner surface of the eyeglass frame. Subsequently, the pulse motor 30 is allowed to rotate in response to a predetermined unit number of rotation pulses. As a result, the gage head shaft 23 which is integral with the gage head 24 moves along the rails 36*a* and 36*b* in accordance with the radius vector of the frame and also moves vertically in accordance with the curved profile of the frame. In response to these movements of the gage head shaft 23, the light shielding plate 25 moves both vertically and horizontally between the LED 28 and the linear image sensor 29 such as to block the light from the LED 28. The light passing through the slits 26 and 27 in the light shielding plate 25 reaches the light-receiving part of the linear image sensor 29 and the amount of movement of the light shielding plate 25 is read. The position of slit 26 is read as the radius vector r of the eyeglass frame and the positional difference between the slits 26 and 27 is read as the height information z of the same frame. By performing this measurement at N points, the configuration of the eyeglass frame is analyzed as (rn, θn, zn) (n=1, 2, . . . , N). The eyeglass frame and template configuration measuring section 2 under consideration is basically the same as what is described in commonly assigned U.S. Pat. No. 5,138,770, to which reference should be made.

For measuring a template, the template is fixed on a template holding portion (see, for example, U.S. Pat. No. 5,347,762) and, the measuring pin 50 is fitted in the mounting hole 51. As in the case of measurement of the eyeglass frame configuration, the pin 50 will move along the rails 36*a* and 36*b* in accordance with the radius vector of the template and, hence, the position of slit 26 detected by the linear image sensor 29 is measured as information radius vector.

(C) Lens Configuration Measuring Section

Figure 5:
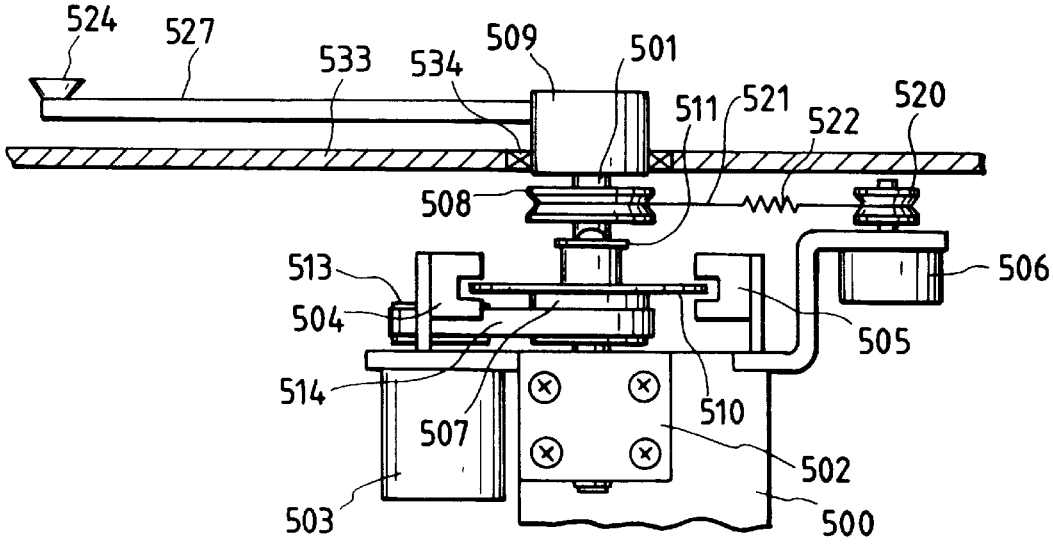
FIG. 5 is a sectional view illustrating the configuration of a lens configuration measuring section.
Figure 6:
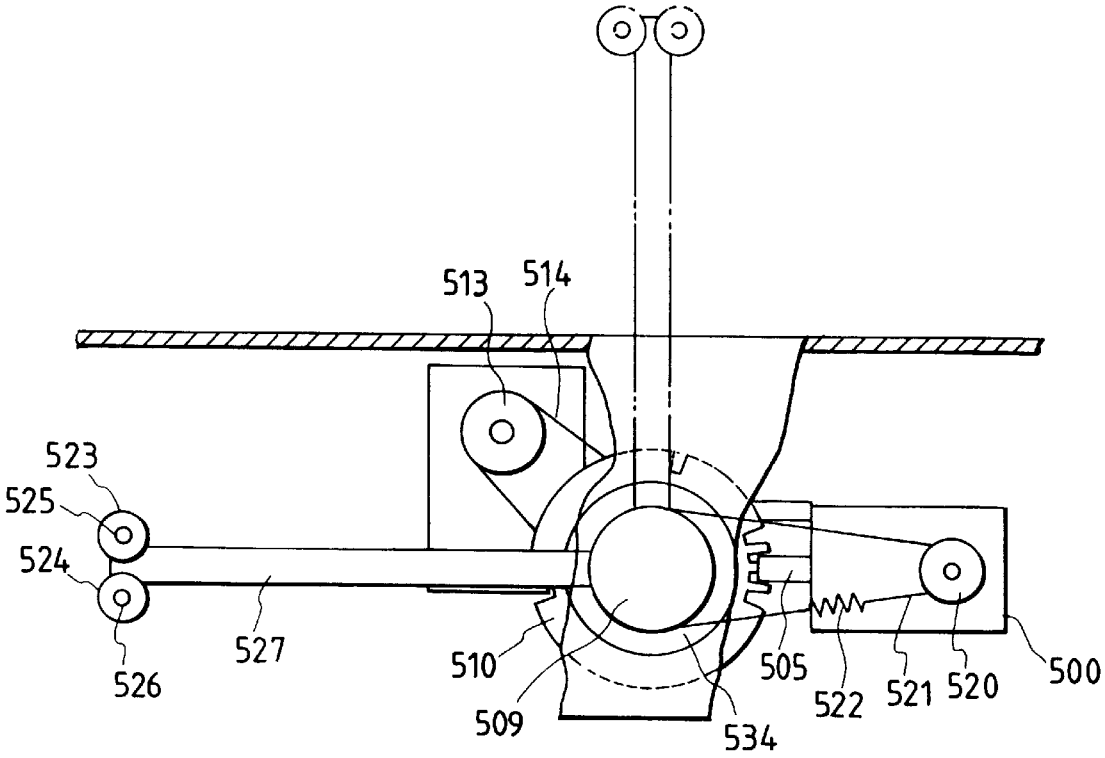
FIG. 6 is a plan view illustrating the configuration of the lens configuration measuring section.

FIG. 5 is a sectional view of the lens configuration measuring section 5, and FIG. 6 is a plan view of the same. The lens configuration measuring section 5 comprises: a measurement arm 527 having two feelers 523 and 524; a rotation mechanism, for rotating the measurement arm 527, including a DC motor 503, a pulley 513, a belt 514, pulley 507, a shaft 501 and a pulley 508; and a detection mechanism including a sensor plate 510 and photoswitches 504 and 505 which cooperatively detecting the rotation of the measurement arm 527 so as to control the rotation of the DC motor 503, and a potentiometer 506 which detects rotation amount of the measurement arm 527 so as to obtain configurations of the lens front and rear surfaces. The arrangement of the lens configuration measuring section 5 under consideration is basically the same as that described in Japanese Patent Kokai Publication No. 3-20603, to which reference should be made.

In the process of measuring the lens configuration (the lens edge thickness), the lens is revolved with the feeler 523 contacting its front refractive surface, whereby the potentiometer 506 detects the amount of rotation of the pulley 508 to obtain the configuration of the lens front refractive surface. Thereafter, with the feeler 524 be brought into contact with the lens rear refractive surface, the configuration thereof is obtained similarly.

(D) Display Section and Input Section

Figure 7:
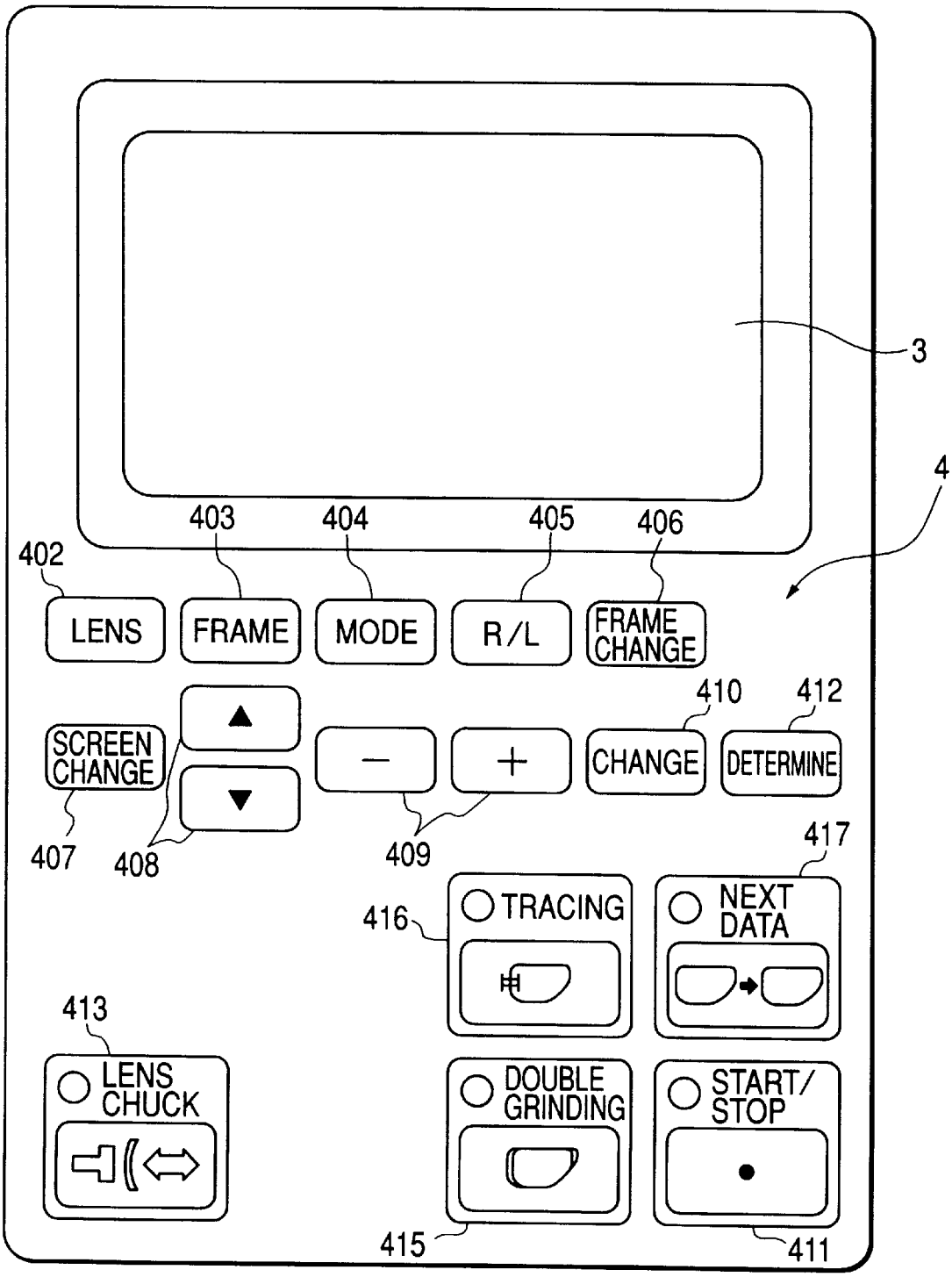
FIG. 7 is an external view illustrating a display section and an input section.

FIG. 7 is a diagram showing the outer appearance of the display section 3 and the input section 4. The display section 3 is formed of a liquid-crystal display and, under the control of a main arithmetic control circuit to be described later, it displays, for example, a parameter setting screen, a layout screen with which layout information can be input, and a bevel simulation screen on which the position of a bevel with respect to the target lens configuration and the cross-sectional condition of the bevel are simulated.

The input section 4 includes various setting switches such as a lens switch 402 for instructing the constituent material of the lens to be processed, a frame switch 403 for distinguishing between plastics and metals as the constituent material of the frame, a mode switch 404 for selecting the mode of lens processing to be performed (whether it is bevel processing, bevel polishing, plane processing or plano-polishing), a R/L switch 405 for determining whether the lens to be processed is for use on the right eye or the left eye, a screen change switch 407 for selecting a screen to be displayed on the display section 3 (the layout screen, the menu screen or the parameter setting screen), move switches 408 for moving a cursor or arrow displayed on the display section 3 to thereby select items to be input, a "+" switch 409*a* and "−" switch 409*b* for numerical data input, a change switch 410 used to change the input manner of the layout data, a START/STOP switch 411 for starting or stopping the lens processing operation, a switch 413 for opening or closing the lens chucks, a tracing switch 416 for giving directions on the eyeglass frame and template tracing, and a next-data switch 417 for transferring the data measured with the eyeglass frame and template configuration measurement section 2.

(E) Electronic Control System for the Apparatus

Figure 8:
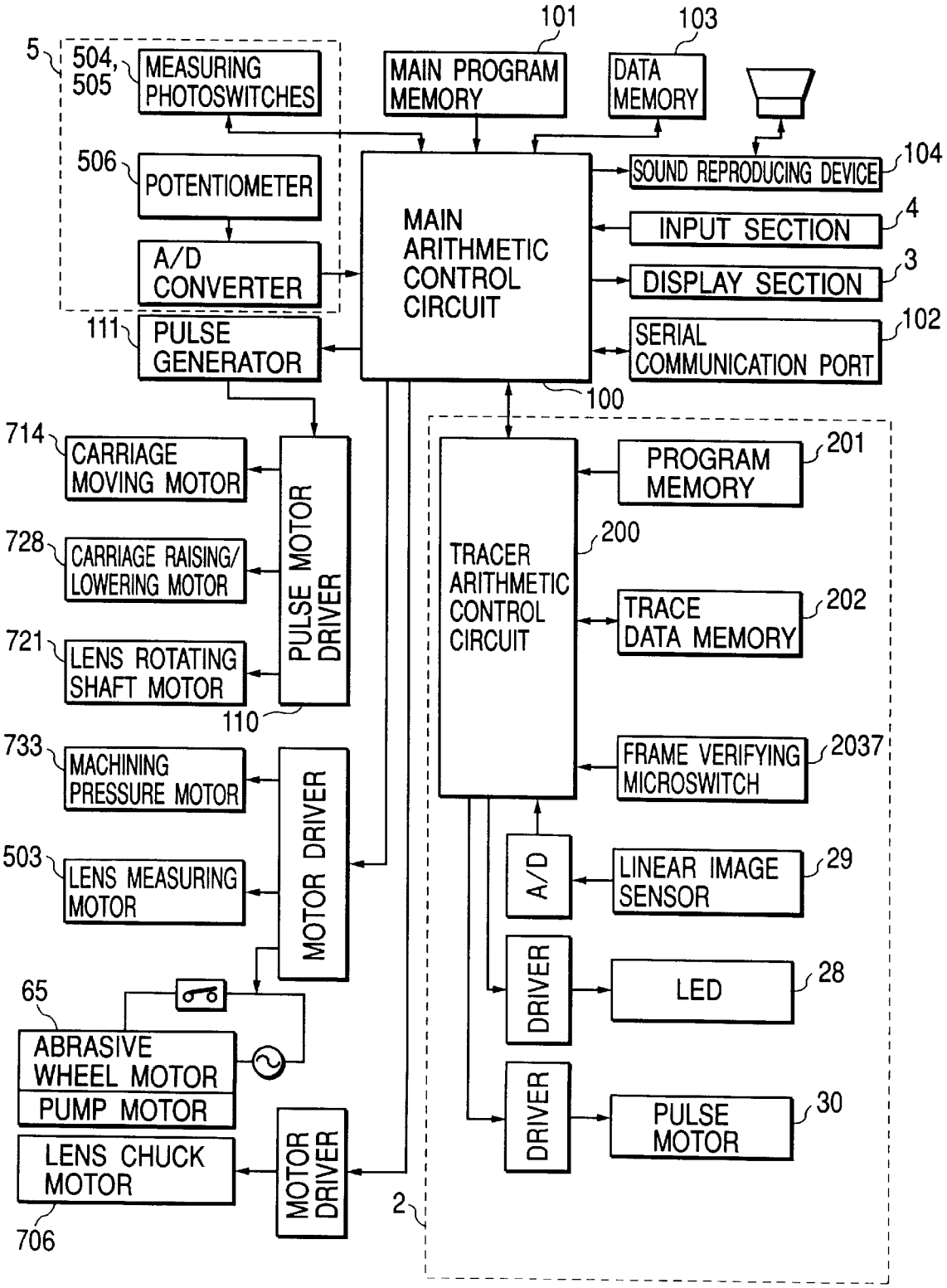
FIG. 8 shows the essential part of a block diagram for the electronic control system of the lens grinding apparatus.

FIG. 8 shows the essential part of a block diagram of the electronic control system for the eyeglass lens grinding apparatus of the invention. A main arithmetic control circuit 100 which is typically formed of a microprocessor and controlled by a sequence program stored in a main program memory 101. The main arithmetic control circuit 100 can exchange data with IC cards, eye examination devices and so forth via a serial communication port 102. The main arithmetic control circuit 100 also performs data exchange and communication with a tracer arithmetic control circuit 200 of the eyeglass frame and template configuration measurement section 2. Data on the eyeglass frame configuration are stored in a data memory 103.

The display section 3, the input section 4, a sound reproducing device 104 and the lens configuration measuring section 5 are connected to the main arithmetic control circuit 100. The measured data of lens which have been obtained by arithmetic operations in the main arithmetic control circuit 100 are stored in the data memory 103. The carriage moving motor 714, as well as the pulse motors 728 and 721 are connected to the main arithmetic control circuit 100 via a pulse motor driver 110 and a pulse generator 111. The pulse generator 111 receives commands from the main arithmetic control circuit 100 and determines how many pulses are to be supplied at what frequency in Hz to the respective pulse motors to control their operation.

The apparatus having the above-described structural design operates in the following manner. First, an eyeglass frame (or a template therefor) is set on the eyeglass frame and template configuration measuring section 2 and the TRACE switch 416 is depressed to start tracing. The eyeglass frame data as obtained by the configuration measuring section 2*a* are stored in a TRACE data memory 202. When the NEXT DATA switch 417 is depressed, the data obtained by tracing are transferred into the apparatus and stored in the data memory 103. At the same time, graphics representing the frame configuration is presented on the screen of the display section 3 based on the eyeglass frame data, rendering the apparatus ready for the entry of processing conditions.

In the next step, the operator while looking at the screen of the display section 3 operates on the input section 4 to enter layout data such as the PD, the FPD and the height of the optical center of user. Based on the eyeglass frame data and the layout data, the apparatus obtains new radius vector information (rsδn, rsθn) and stores it in the data memory 103.

Subsequently, the operator determines the constituent material of the lens to be processed and the constituent material of the frame and whether the lens is for use on the right or left eye, and enters the necessary data. In addition, the operator selects the necessary processing mode with the MODE switch 404 . On the pages that follow, the operation of the apparatus in the mode of plano-polishing of a plastic lens will be described.

After entering the processing conditions, the lens to be processed is subjected to specified preliminary operations (e.g., centering of the suction cup) and chucked between the lens rotating shafts 704*a* and 704*b*. Then, the START/STOP switch 411 is depressed to turn on the apparatus.

In response to the entry of a START signal, the apparatus performs arithmetic operations to effect processing correction (correction of the diameter of the grinding wheel to be used) for processing the lens to the shape represented by the radius vector information (rsδn, rsθn) (see, for example, U.S. patent application Ser. No. 5,347,762). Thereafter, the carriage 700 is moved such that the lens is positioned to confront the grinding wheel 60*b* for rough processing of plastic lenses and the apparatus performs rough processing based on the obtained information about processing correction.

After the end of the rough grinding, the process goes to the finishing operation. The lens is moved to be positioned above the flat portion of the finishing abrasive wheel 60*c* and the lens periphery is finely ground on the basis of the information about processing correction. As a result, the lens is processed to the shape represented by the radius vector information (rsδn, rsθn).

The next step is polishing. The apparatus performs calculations for the necessary processing correction and moves the lens to be positioned above the flat portion of the polishing abrasive wheel 60*d* and the lens periphery is polished with the drive of the associated motors being controlled on the basis of the information about processing correction for polishing.

Figure 9:
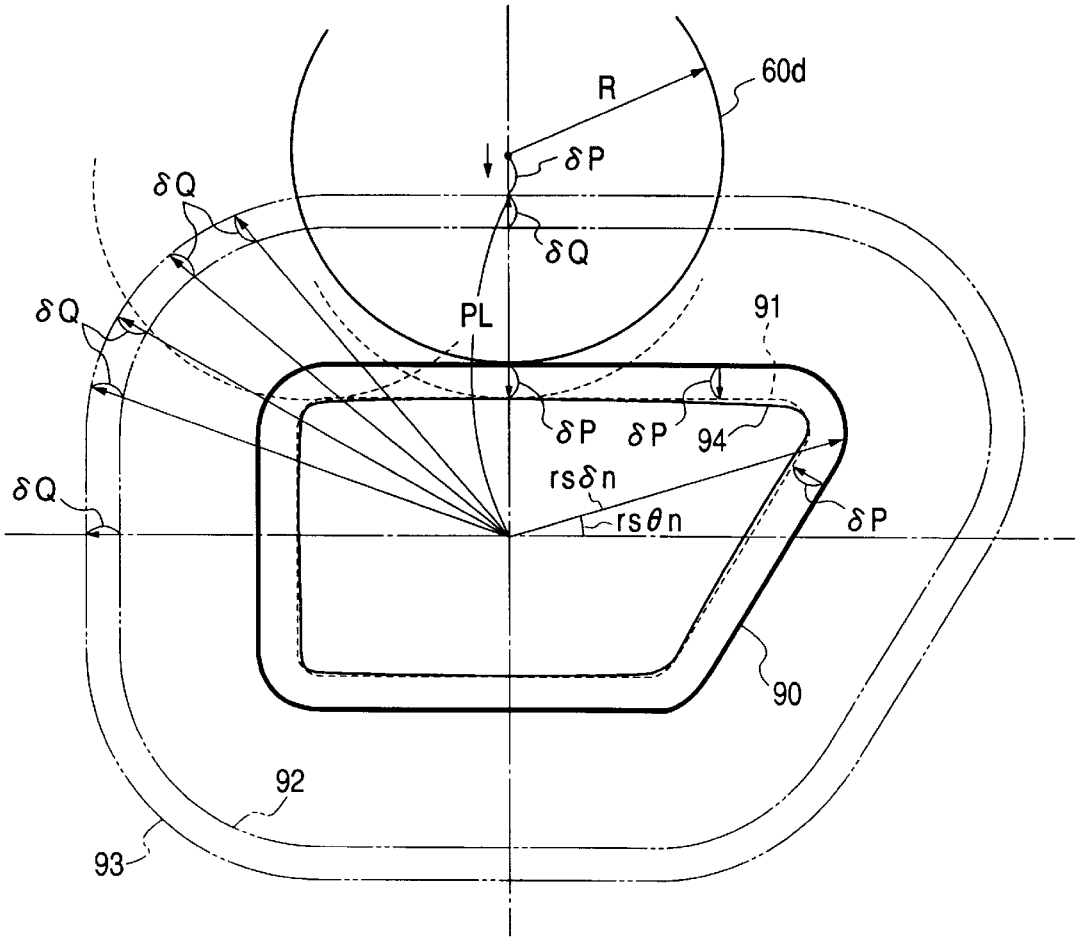
FIG. 9 illustrates how correction is made for polishing.

We now describe the processing correction for polishing. Suppose here that the edge surface of a lens finished to the shape indicated by a solid line 90 in FIG. 9 is further processed with the polishing abrasive wheel 60*d* by the amount δP to give the shape indicated by a broken line 91. It should be mentioned that the amount of polishing which is very small in practical operations is shown exaggerated in FIG. 9 for the sake of convenience in explanation.

Write R for the radius of the polishing abrasive wheel 60*d* and PL for the axis-to-axis distance between each lens rotating shaft 704*a*, 704*b* and the abrasive wheel rotating shaft 61*a*. On the basis of the radius vector information (rsδn, rsθn) representing the shape to be obtained after finish processing, perform calculations for the same processing correction as in the case of rough and finish processing using a radius (R−δP−δQ), where δP is the amount of polishing and δQ is a specified amount of correction. To be more specific, the radius vector information (rsδn, rsθn) is first read out of the data memory and subjected to the following calculation:

$$PL = rs\delta n \cos rs\theta n + \sqrt{(R-\delta P-\delta Q)^2-(rs\delta n \sin rs\theta n)^2} \quad (1)$$

$$(n=1, 2, 3, \ldots, N)$$

Then, the radius vector information (rsδn, rsθn) is rotated about the center of processing by a small given angle and the same calculation as expressed by eq. (1) is performed. Write $\xi i$ (i=1, 2, 3, . . . , N) for the angle of rotation in the coordinate system of interest and make a rotation for 360 degrees from $\xi 1$ to $\xi N$. Determine $PLmax_i$ which is a maximum of PL at each rotational angle $\xi i$. Subsequently, an offset for the amount of correction $\delta Q$ is added to the $PLmax_i$ in a direction in which PL increases, thereby yielding information about processing correction for polishing, ($PLmax_i+\delta Q$, $\xi i$) (i=1, 2, 3, . . . , N).

Consider here the locus of the center of the polishing abrasive wheel 60*d* which is assumed to move relative to the lens being processed. The locus of the center of the polishing abrasive wheel 60*d* in the case of the radius ($R-\delta P-\delta Q$) is as indicated by a two-dotted chain line 92 in FIG. 9. On the other hand, the locus after the addition of $\delta Q$ is as indicated by another two-dotted chain line 93. If polishing is performed with the polishing abrasive wheel 60*d* of the radius R following the locus 93, namely, in accordance with the information about processing correction for polishing ($PLmax_i+\delta Q$, $\xi i$) (i=1, 2, 3, . . . , N), the edge surface of the lens having the shape represented by the radius vector information ($rs\delta n$, $rs\theta n$) is processed as shown geometrically by a solid line 94, such that the amount of processing $\delta P$ is secured if the point of processing lies on the line connecting the abrasive wheel rotating shaft and each lens rotating shaft whereas the amount of processing becomes greater than $\delta P$ as the point of processing departs from the line.

In the actual case, the amount of processing is influenced by the lens relief which is caused by the rigidity of the lens chucking/holding portion. As a result, the offset for the amount of correction $\delta Q$ will work in a direction that cancels the effect of lens relief during processing, whereby the polishing can be performed almost uniformly with the amount of processing substantially kept at $\delta P$.

This offers the advantage that even if $\delta P$ is set to a very small amount such as 0.05 mm, a lens having a thick edge can be processed by polishing with no portion being left unpolished. In addition, the amount of processing can be set to such a small value that the lens configuration after processing will have smaller variations caused due to the difference of the edge thickness. It should be mentioned here that the amount of correction $\delta Q$ may be determined empirically such that it will be optimal for the purpose of compensating for the effect of lens relief during processing.

While the foregoing description is directed to the case of plano-polishing, or processing a flat portion of the lens edge by polishing, it should be noted that the concept of the invention is also applicable to the case of processing a bevelled portion of the lens edge by polishing and arithmetic operations may be performed in the same manner as described above to effect correction for polishing with respect to the shape of a lens that has been bevelled with the finishing abrasive wheel 60*c*. During polishing, the lens is positioned in the bevel groove formed on the periphery of the polishing abrasive wheel 60*d* and the associated motors are controlled on the basis of the bevelling information and the information about correction for polishing. In the bevelling process the lens configuration measuring section 5 is operated to measure the configuration of the lens and, thereafter, the bevelling information is obtained by performing bevel calculations for determining the position of the bevel apex based on the thus obtained data on lens configuration (edge position). The position of the bevel apex may be calculated by various methods including one of dividing the edge thickness of the lens by a specified ratio and a method in which the position of the bevel apex is displaced rearwardly by a specified amount from the position of the edge of the front surface of the lens and a bevel curve which is the same as the curve of the front surface is established. For further details of the bevelling process, see U.S. Pat. No. 5,347,762 and so forth.

In addition, as already mentioned, the amount of polishing can be set to a very small value. Therefore, in the area of the lens around the point of inflection of its shape (i.e., the area where the point of processing lies on the line connecting the abrasive wheel rotating shaft and each lens rotating shaft), the configurational variations of the polished lenses caused due to the difference of the edge thickness can be made particularly small. Therefore, lenses that have been processed by polishing after bevelling can snugly fit to the user's eyeglass frame.

The foregoing description of the correction for polishing assumes the correction of the locus of processing with the polishing abrasive wheel. Alternatively, the locus of processing with the finishing abrasive wheel that is performed before polishing may be corrected such that the amount of polishing increases as the point of processing departs from the line connecting the abrasive wheel rotating shaft and each lens rotating shaft. The procedure of correction for processing in this alternative case is described below.

First, the processing of the lens with the finishing abrasive wheel is corrected using a radius ($R'+\delta Q'$) where R' is the radius of the finishing abrasive wheel 60*c* and $\delta Q'$ is a specified amount of correction. As in the aforementioned correction for polishing, the axis-to-axis distance between each lens rotating shaft and the abrasive wheel rotating shaft is determined and expressed as L'. In correspondence with the radius vector information ($rs\delta n$, $rs\theta n$), L' is calculated along the entire periphery of the lens for each small given angle of rotation $\xi i$ (i=1, 2, 3, . . . , N) and $L'max_i$, or a maximum for each $\xi i$, is determined. BY subtracting an offset for the amount of correction $\delta Q'$ from $L'max_i$, one can yield information about processing correction for finish processing ($L'max_i-\delta Q'$, $\xi i$) (i=1, 2, 3, . . . , N). If the lens is finished with the finishing abrasive wheel 60*c* of the radius R' on the basis of the thus obtained information about processing correction, the lens to be subjected to polishing is processed to a lens shape represented by the radius vector information ($rs\delta n$, $rs\theta n$) in such a way that the amount of processing increases as the point of processing departs from the line connecting the abrasive wheel rotating shaft and each lens rotating shaft.

In the next step, i.e. polishing, correction is performed using a radius ($R-\delta P$) where R is the radius of the polishing abrasive wheel 60*d* and $\delta P$ is the amount of polishing. Given this information about correction for polishing, the lens is processed to a shape that is $\delta P$ smaller than that represented by the radius vector information ($rs\delta n$, $rs\theta n$). In the actual case, the amount of processing is influenced by lens relief, so the polishing can be performed on the finished lens shape almost uniformly with the amount of polishing being substantially kept at $\delta P$. It should also be mentioned that the amount of lens relief is specified by the relationship between the shape to which the lens is to be processed and the rigidity of the lens holding portion or the like and, in practice, the amount of correction $\delta Q'$ is preferably specified on an empirical basis.

On the foregoing pages, the first embodiment of the invention has been described with reference to the case where the carriage mechanism of the lens grinding apparatus has two lens rotating shafts between which the lens to be processed is held. Alternatively, as described in European Patent Publication No. 798 076 A1, the concept of the invention is equally applicable to a lens grinding apparatus which is adapted to be such that a plurality of grinding wheel rotating shafts, each having a grinding wheel, are moved relative to a lens rotating shaft.

Second Embodiment

In the first embodiment, the locus of processing was determined in consideration of lens relief that would occur during processing on account of the mechanical rigidity of the lens holding shafts. If the lens grinding apparatus has high rigidity in the lens holding shafts (as described in European Patent Publication No 798 076 A1), a locus of processing is obtained so that the amount of polishing becomes generally uniform, and the polishing is carried out in accordance with the thus obtained locus.

Figure 10:
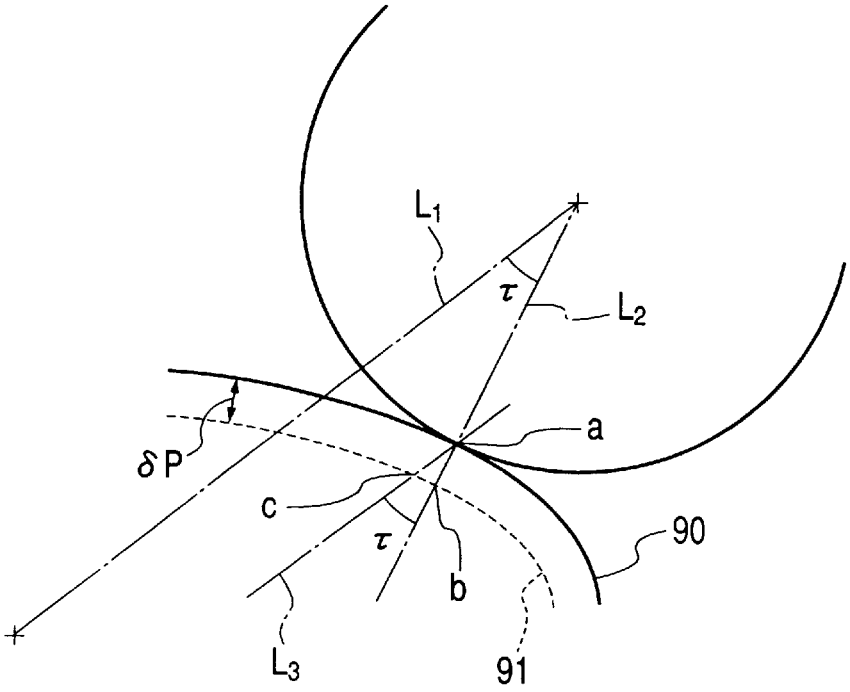
FIG. 10 illustrates how a polishing locus is determined in a second embodiment of the invention.

The method of determining the stated processing locus will now be described with reference to FIG. 10. As in the first embodiment, assume that the edge surface of a lens finished to the shape indicated by a solid line 90 in FIG. 10 is further processed with the polishing abrasive wheel by the amount δP to give the shape indicated by a broken line 91. Also write L1 for the line connecting the center of lens rotation and the center of abrasive wheel rotation, L2 for the line dropped normal to the lens profile at point a on the edge surface of the finished lens (i.e., the line connecting point a and the center of abrasive wheel rotation), and τ for the angle of the normal line L2 with respect to the center-to-center line L1. Since the position of the center of abrasive wheel rotation and that of point a are determined from the locus of finish processing, the angle τ is known prior to polishing.

Consider line L3 which extends from point a parallel to the center-to-center line L1. If the point of crossing between the broken line 91 and the normal line L2 is written as b and that of crossing between the broken line 91 and the line L3 as c and if the angle formed between the line segment ab (=δP) of the triangle abc and the line segment bc thereof is approximated by 90 degrees, the length of ac is expressed by δP/cosτ. By subtracting the length of ac (=δP/cosτ) from the axis-to-axis distance L used for obtaining the locus of finish processing, an axis-to-axis distance is determined for use in processing the lens at point b on the broken line 91. By calculating this axis-to-axis distance at all sites in correspondence with the radius vector, one can readily determine a locus for polishing which, as indicated by the broken line 91, allows for a generally uniform amount of polishing.

It should be noted here that as in the case of the first embodiment and as described in U.S. Pat. No. 5,347,762, the axis-to-axis distance L between each lens rotating shaft and the abrasive wheel rotating shaft is calculated by the following equation:

$$L = rs\delta n \cos rs\theta n + \sqrt{R^2 - (rs\delta n \sin rs\theta n)^2} \quad (2)$$

$$(n=1, 2, 3, \ldots, N)$$

then, in correspondence with the radius vector information, L is calculated along the entire periphery of the lens for each small given angle of rotation ξi (i=1, 2, 3, . . . , N) and $Lmax_i$, or a maximum for each ξi, is determined, whereby the information about the locus of processing with the polishing abrasive wheel is obtained as expressed by ($Lmax_i$, ξi). Hence, if the angle which is determined for each small given angle of rotation ξi is written as τi, the processing information for the locus of polishing is determined as ($Lmax_i$−δP/cosτi, ξi) (i=1, 2, 3, . . . , N).

Thus, a polishing locus that provides a generally uniform amount of processing can be determined by simple arithmetic operations and the short calculation time contributes to shorten the overall processing time.

As described on the foregoing pages, the lens grinding apparatus of the invention enables the edge of a lens to be processed to a satisfactory polished surface. In addition, the lens shape after the polishing is free from variations in spite of the difference in edge thickness and, hence, the polished lenses can snugly fit into the user's eyeglass frame.

What is claimed is:

1. A lens grinding apparatus for grinding a lens such that it conforms to the shape of an eyeglass frame, said apparatus comprising:

frame configuration data input means for entering data on the configuration of the eyeglass frame;

layout data input means for entering data to be used in providing a layout of the lens corresponding to the eyeglass frame;

lens rotating shafts holding the lens therebetween to rotate it about a first axis, at least one abrasive wheel rotating shaft having a finishing abrasive wheel and a polishing abrasive wheel, the polishing abrasive wheel having at least a partially cylindrical surface;

a computing unit which obtains a finishing processing path locus on the basis of the data inputted by the frame configuration data input means and the layout data input means and adds a correction amount to an amount of polishing processing uniform in a direction of a normal line to the finishing processing path locus to cancel an error generated due to a mechanical strength of the lens rotating shafts, the correction amount increasing as a processing point by the polishing abrasive wheel is located farther from a linear line connecting an axis of the abrasive wheel rotating shaft to the first axis; and processing control means for controlling the processing of the lens based on the result of calculation by the computing unit.

2. A lens grinding apparatus according to claim 1, wherein said computing unit includes:

first corrected locus computing means for obtaining a first corrected locus such that the finishing processing path locus is corrected on the basis of the diameter of the polishing abrasive wheel, the amount of polishing processing and a specified amount of correction; and second corrected locus computing means for obtaining a second corrected locus such that the first corrected locus is adjusted by the specified amount of correction along the linear line connecting the axis of the abrasive wheel rotating shaft to the first axis and, wherein the processing control means controls the polishing processing on the basis of the second corrected locus.

3. A lens grinding apparatus according to claim 1, wherein said computing unit includes:

first corrected locus computing means for obtaining a first corrected locus such that the finishing processing path locus is corrected on the basis of the diameter of the finishing abrasive wheel and a specified amount of correction; and second corrected locus computing means for obtaining a second corrected locus such that the first corrected locus is adjusted by the specified amount of correction along the linear line connecting the axis of the abrasive wheel rotating shaft to the first axis; and third corrected locus computing means for obtaining a third corrected locus such that the finishing processing path locus is corrected on the basis of the diameter of the polishing abrasive wheel and the amount of polishing processing, and wherein the processing control means controls the finishing processing based on the second corrected locus and the polishing processing based on the third corrected locus.

4. A lens grinding apparatus for grinding a lens such that it conforms to the shape of an eyeglass frame, said apparatus comprising:

data input means for entering data on the configuration of the eyeglass frame and data to be used in providing a layout of the lens corresponding to the eyeglass frame;

lens rotating shafts holding the lens therebetween to rotate it about a first axis;

an abrasive wheel rotating shaft having a polishing abrasive wheel and rotating about a second axis, the polishing abrasive wheel having at least a partially cylindrical surface;

a computing unit which obtains for each contact point between the polishing abrasive wheel and a finishing processing path locus, a first linear line that passes through a corresponding one of the contact points and that is parallel to a second linear line connecting the first axis to the second axis, thereby calculating polishing data on an axis-to-axis distance between the first axis and the second axis during polishing processing; and processing control means for controlling the processing of the lens based on the result of calculation by the computing unit.

5. A lens grinding apparatus according to claim 4, wherein said computing unit obtains a correction amount by dividing an amount of polishing processing by $\cos\tau$, where $\tau$ is an angle between a third linear line connecting the corresponding one of the contact points to the second axis and the second linear line and obtains a polishing processing path locus such that the finishing processing path locus is adjusted by the correction amount along the linear line connecting the first axis and the second axis.

* * * * *